US012637831B1

(12) United States Patent
Bounds et al.

(10) Patent No.: US 12,637,831 B1
(45) Date of Patent: May 26, 2026

(54) RIPPER BUCKET

(71) Applicants: Kevin Lee Bounds, Nevada, TX (US); Justin Lee Gregory, Caddo Mills, TX (US)

(72) Inventors: Kevin Lee Bounds, Nevada, TX (US); Justin Lee Gregory, Caddo Mills, TX (US)

( * ) Notice: Subject to any disclaimer, the term of this patent is extended or adjusted under 35 U.S.C. 154(b) by 378 days.

(21) Appl. No.: 18/368,673

(22) Filed: Sep. 15, 2023

Related U.S. Application Data

(60) Provisional application No. 63/407,158, filed on Sep. 16, 2022.

(51) Int. Cl.
*E02F 5/32* (2006.01)
*E02F 9/22* (2006.01)

(52) U.S. Cl.
CPC . *E02F 5/32* (2013.01); *E02F 9/22* (2013.01)

(58) Field of Classification Search
CPC . E02F 5/32; E02F 5/106; E02F 3/7604; E02F 3/404; E02F 3/60
USPC ..... 37/404, 405, 409
See application file for complete search history.

(56) References Cited

U.S. PATENT DOCUMENTS 2,042,196 A * 5/1936 Senz ..... E02F 3/8155 404/90
2,416,654 A * 2/1947 Taylor ..... E02F 3/8152 172/778
2,899,760 A * 8/1959 Armington et al. .. E02F 3/8155 172/476
2,993,285 A * 7/1961 Hoxie ..... E02F 3/8155 172/777
3,034,238 A * 5/1962 Mcgee ..... A01B 35/00 172/197
3,048,292 A * 8/1962 Kohorst ..... E02F 3/407 37/444
3,065,557 A * 11/1962 Pewthers ..... E02F 3/405 37/447
3,305,953 A * 2/1967 Von Mehren ..... E02F 3/405 37/447
3,938,680 A * 2/1976 Grimes ..... E02F 3/401 37/409
4,407,080 A * 10/1983 Mann ..... E02F 3/7609 37/405
4,512,090 A * 4/1985 Billings ..... E02F 3/815 37/405
4,566,844 A * 1/1986 Campin ..... E02F 3/404 37/409
4,625,438 A * 12/1986 Mozer ..... E02F 3/405 37/447
4,799,852 A * 1/1989 Ramun ..... E02F 3/404 37/406

(Continued)

*Primary Examiner* — Christopher J Sebesta
*Assistant Examiner* — Audrey L Lusk
(74) *Attorney, Agent, or Firm* — Plager Schack LLP; Mark H. Plager; Kara K. Verryt

(57) ABSTRACT

A ripper bucket configured to perform both ripper and bucket operations may include a bucket portion including a bottom wall, a left sidewall, a right sidewall, a back wall, and an interior panel together forming a conventional bucket shape; at least one hydraulic system housed within a space between the interior panel and the back wall; and retractable ripper teeth operatively attached to the at least one hydraulic system, the retractable teeth configured to extend from and retract into a bottom corner of the bucket portion, wherein the ripper bucket is configured to be mounted to a skid steer.

5 Claims, 4 Drawing Sheets

(56) References Cited

U.S. PATENT DOCUMENTS 4,959,915 A * 10/1990 Roussin ..... E02F 5/323 37/447
4,967,850 A * 11/1990 Bargfrede ..... F41H 11/24 172/197
5,953,839 A * 9/1999 Meeks ..... E02F 3/963 37/444
6,546,650 B1 * 4/2003 Meurer ..... E02F 3/401 37/405
6,910,290 B1 * 6/2005 Meurer ..... E02F 3/404 37/405
7,575,067 B1 * 8/2009 Reyes ..... E02F 3/961 172/684.5
8,449,241 B2 * 5/2013 Fritsch ..... E02F 3/3414 37/405
8,875,421 B2 * 11/2014 Paull ..... E02F 9/265 37/444
11,492,776 B1 * 11/2022 Antonelli ..... E02F 3/404
11,859,366 B1 * 1/2024 English ..... E02F 9/2816
2008/0127532 A1 * 6/2008 Reid ..... E02F 3/404 37/445
2008/0313934 A1 * 12/2008 Smoljo ..... E02F 3/8155 37/409
2011/0297405 A1 * 12/2011 Fraley ..... E02F 3/7622 172/684.5
2013/0062082 A1 * 3/2013 Layton ..... E01C 23/082 172/445.1
2013/0160334 A1 * 6/2013 May ..... E02F 3/7627 37/405
2013/0284466 A1 * 10/2013 Layton ..... E02F 9/024 172/1

* cited by examiner

RIPPER BUCKET

RELATED APPLICATION

This application claims priority to provisional patent application U.S. Ser. No. 63/407,158 filed on Sep. 16, 2022, the entire contents of which is herein incorporated by reference.

BACKGROUND

The embodiments described herein relate generally to machinery and, more particularly, to a ripper bucket designed to be used with skid steer equipment.

When breaking down and spreading/moving dirt during, for example, excavation, digging, or trenching, generally multiple pieces of machinery are required. Specifically, an excavating or backhoe ripper may be necessary to dig and break up dirt, while a separate skid steer with a bucket attachment is necessary for spreading and moving the dirt. Conventionally, no machinery exists that can perform both ripper and bucket operations at the same time.

Therefore, what is needed is device that allows for ripper and bucket operations using a single piece of machinery.

SUMMARY

Some embodiments of the present disclosure include a ripper bucket configured to perform both ripper and bucket operations. The ripper bucket may include a bucket portion including a bottom wall, a left sidewall, a right sidewall, a back wall, and an interior panel together forming a conventional bucket shape; at least one hydraulic system housed within a space between the interior panel and the back wall; and retractable ripper teeth operatively attached to the at least one hydraulic system, the retractable teeth configured to extend from and retract into a bottom corner of the bucket portion, wherein the ripper bucket is configured to be mounted to a skid steer.

BRIEF DESCRIPTION OF THE FIGURES

The detailed description of some embodiments of the invention is made below with reference to the accompanying figures, wherein like numerals represent corresponding parts of the figures.

DETAILED DESCRIPTION

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used as a ripper bucket for use with a skid steer and may comprise the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

The various elements of the present disclosure may be related in the following exemplary fashion. It is not intended to limit the scope or nature of the relationships between the various elements, and the following examples are presented as illustrative examples only.

By way of example, and referring to FIGS. 1-7, some embodiments of the present disclosure include a ripper bucket for use with a skid steer 42, wherein the ripper bucket is configured to perform both ripper and bucket operations without requiring the change out of implements between work tasks. Specifically, the ripper bucket of the present disclosure may comprise a bucket portion 10 comprising a bottom wall, a pair of side walls, a back wall, and an interior panel 44 together forming a conventional bucket shape, and retractable ripper teeth 20 operatively mounted to the back wall of the bucket portion 10, wherein the ripper bucket is configured to attached to a skid steer 42 such that the bucket portion 10 opens away from the skid steer 42 and the ripper teeth 20 extend outward from the back wall of the bucket portion 10 toward the skid steer 42.

Figure 5:
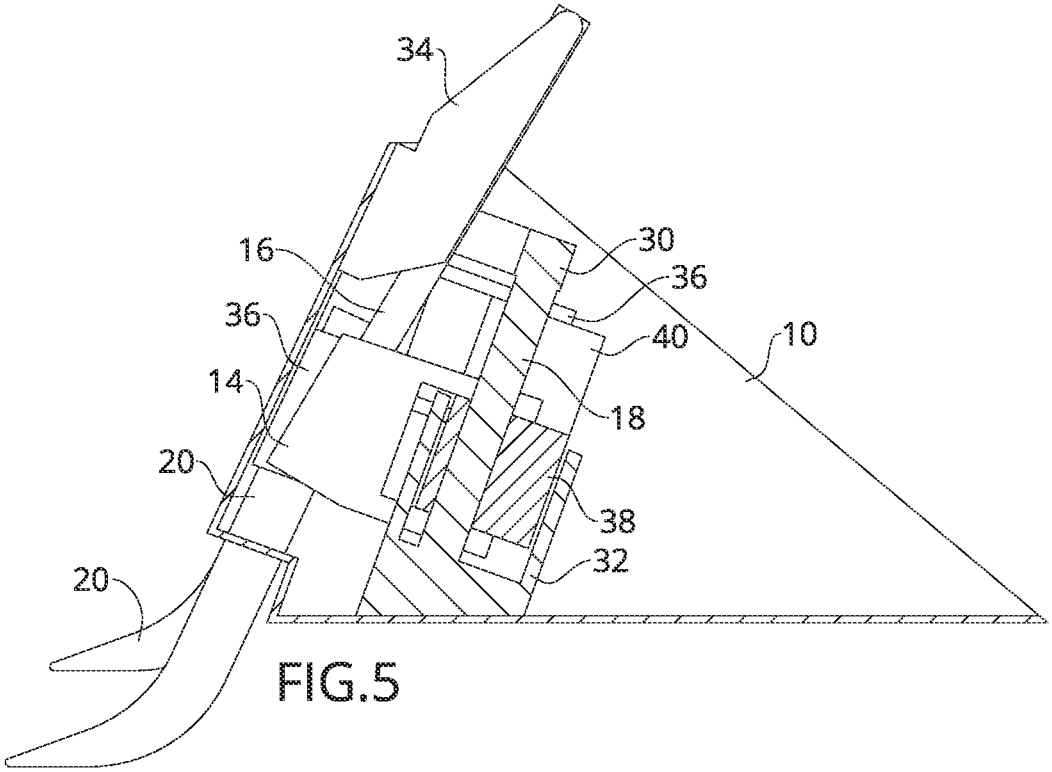
FIG. 5 is a section view of one embodiment of the present disclosure, taken along line 5-5 in FIG. 4.
Figure 6:
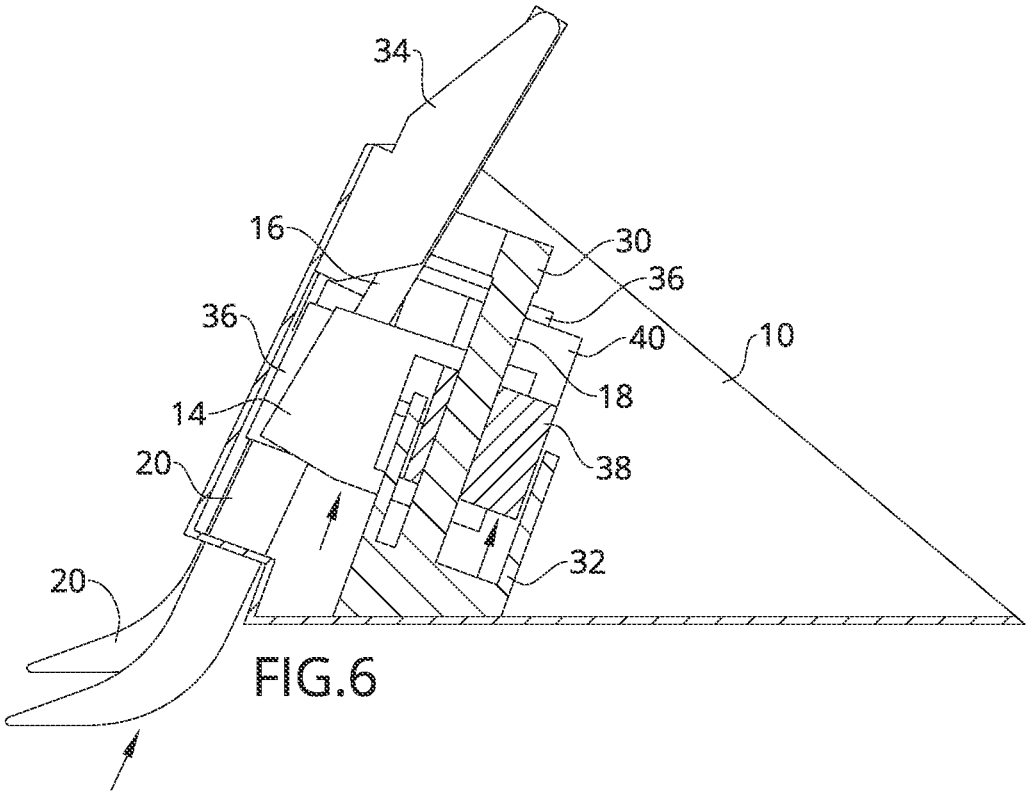
FIG. 6 is a section view of one embodiment of the present disclosure, showing motion of ripper teeth 20.
Figure 7:
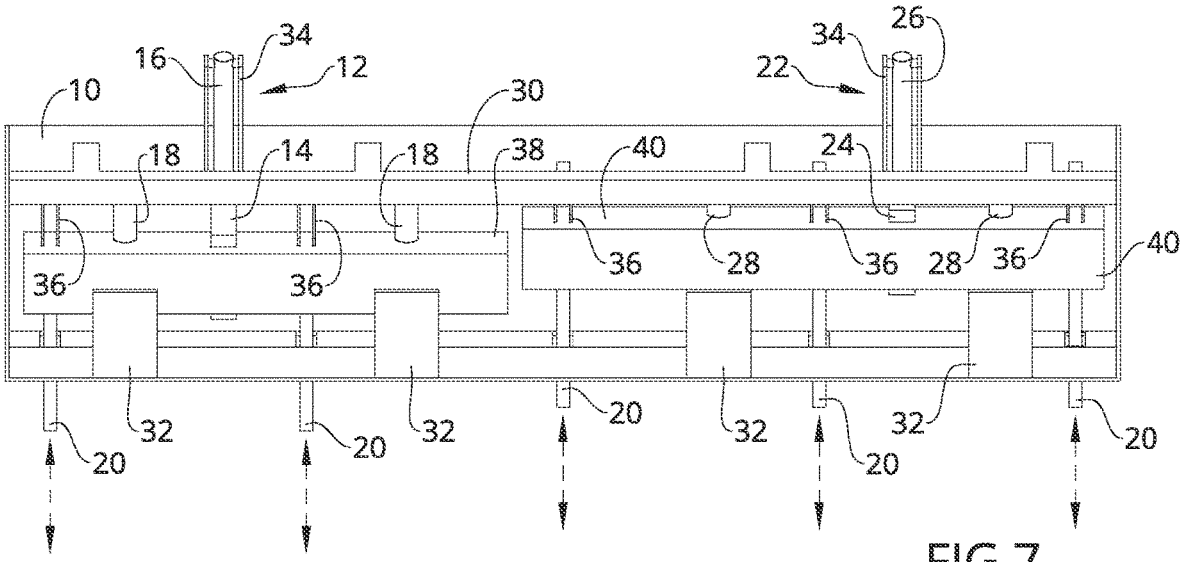
FIG. 7 is a back view of one embodiment of the present disclosure, showing motion of ripper teeth 20.

In embodiments, the bucket portion 10 may comprise a back wall and an interior panel 44 as mentioned above. A space between the interior panel 44 and the back wall may define a chamber sized to house at least one hydraulic system, wherein the at least one hydraulic system is designed to extend and retract the ripper teeth 20 from a rear bottom edge of the bucket portion 10. More specifically, the rear bottom corner of the bucket portion 10 may comprise a plurality of orifices extending therethrough, wherein the ripper teeth 20 are configured to extend out of and retract into the orifices, as desired and as shown in FIGS. 5-7.

As described above, the ripper bucket of the present disclosure may comprise at least one hydraulic system configured to drive movement of the ripper teeth 20. In a particular embodiment and as shown in the Figures, the ripper bucket may comprise a first hydraulic system 12 and a second hydraulic system 22, wherein the first hydraulic system 12 is configured to drive movement of a first set of ripper teeth 20 and the second hydraulic system 22 is configured to drive movement of a second set of ripper teeth 20. Each set of ripper teeth 20 may comprise at least one individual ripper tooth 20.

Figure 1:
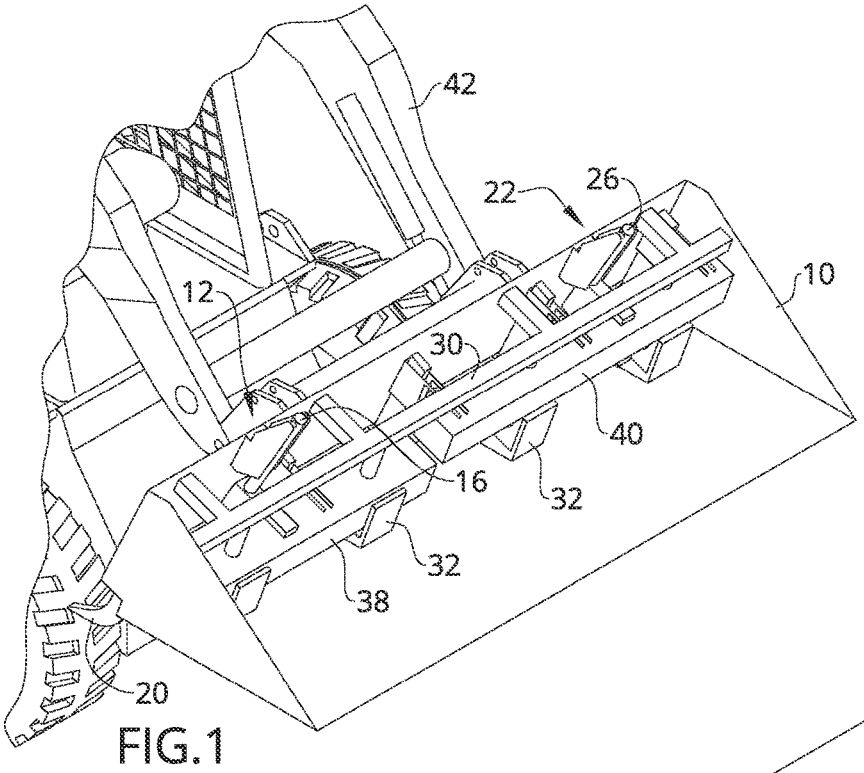
FIG. 1 is a perspective view of one embodiment of the present disclosure, shown in use.
Figure 2:
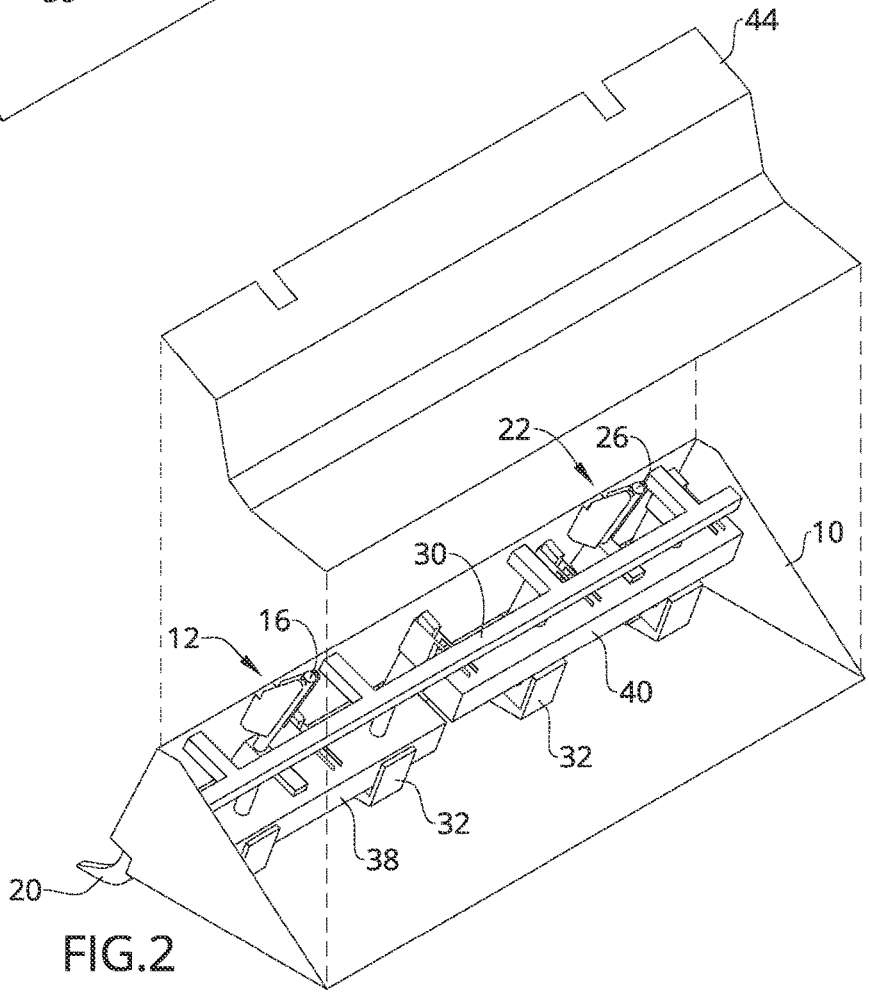
FIG. 2 is an exploded view of one embodiment of the present disclosure.
Figure 3:
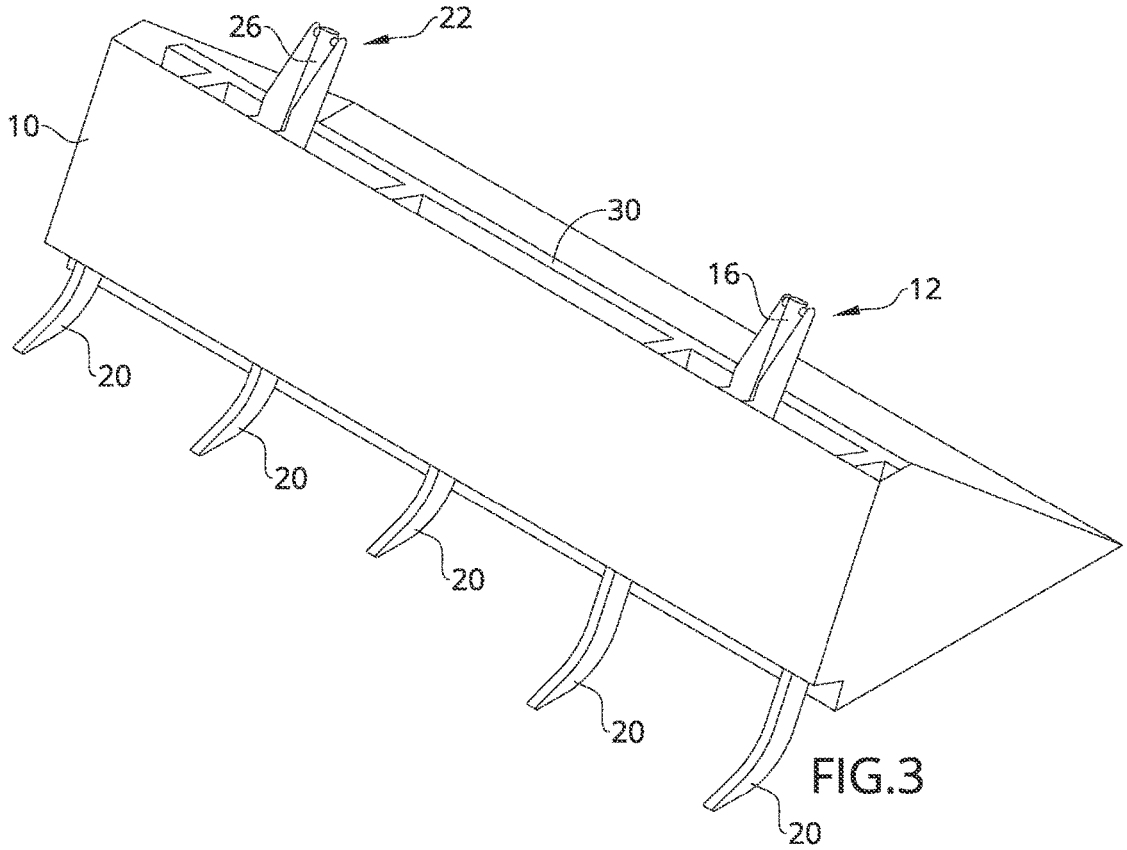
FIG. 3 is a top back perspective view of one embodiment of the present disclosure.
Figure 4:
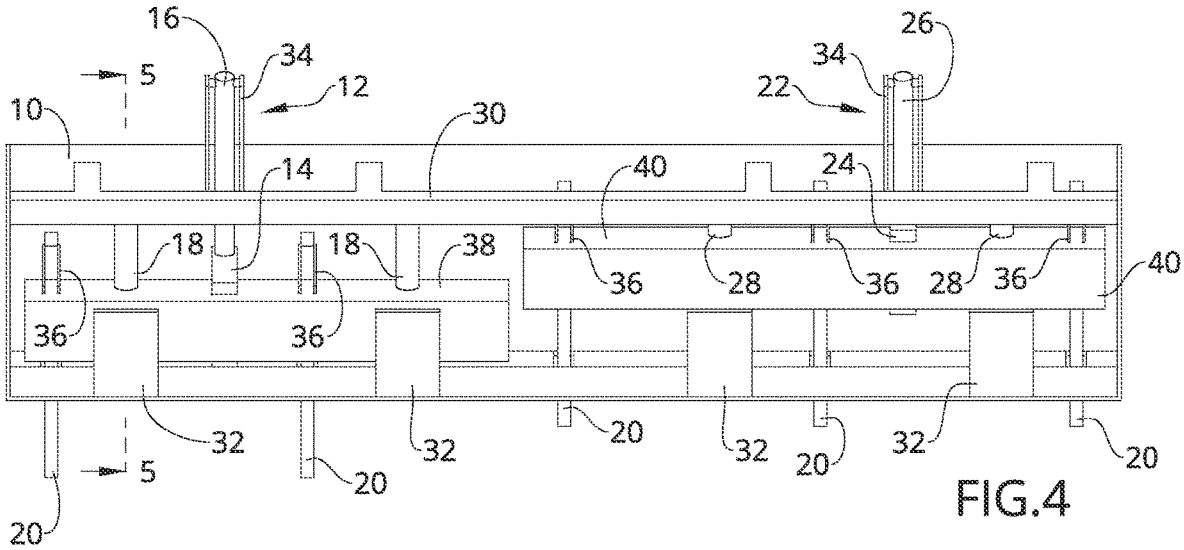
FIG. 4 is a front view of one embodiment of the present disclosure.

As shown in, for example, FIG. 4, the first hydraulic system 12 may comprise a first hydraulic rod 16 attached to a crossbar 30, wherein a plurality of linear rams or first ram rods 18 extend downward from the crossbar 30, and wherein a first ram bar 38 is operatively engaged with the first hydraulic rod 16 and slidably attached to the plurality of first ram rods 18 such that the first ram bar 38 may move up and down along a height of the first ram rods 18 and wherein actuation of the first hydraulic rod 16 pulls the first ram bar 38 downward along the height of the first ram rods 18. The first ram bar 38 may be operatively attached to the first set of ripper teeth 20. For example, a plurality of ripper teeth 20 may extend downward from the first ram bar 38, wherein each ripper tooth 20 is secured to the first ram bar 38 using a ripper tooth bracket 36. In some embodiments, such as that shown in FIG. 4, the ripper teeth 20 may extend through the first ram bar 38, wherein a top end of each ripper tooth 20 is secured within a ripper tooth bracket 36 attached to a top surface of the first ram bar 38. Thus, when the first hydraulic rod 16 is actuated, the first ram bar 38 may be pulled downward on the first ramrods 18 and toward the bottom corner of the bucket portion 10, causing the ripper teeth 20 to extend outward from orifices in the rear bottom corner of the bucket portion 10, thus resulting in the first plurality of ripper teeth 20 being in the extended or ripper configuration, as shown in FIG. 5. When the first hydraulic rod 16 is released, the first ram bar 38 may move back along the first ram rods 18 and away from the rear bottom corner of the bucket portion 10, thus pulling the first set of ripper teeth 10 back into the orifice in the rear bottom corner of the bucket portion 10, resulting in the first set of ripper teeth 20 being in the retracted or bucket configuration, as shown in FIG. 7.

Similar to the first hydraulic system 12, the second hydraulic system 22 may comprise a second hydraulic rod 26 attached to the crossbar 30, wherein the crossbar 30 extends from the inner surface of the right sidewall of the bucket portion 10 to the left sidewall of the bucket portion 10. A plurality of linear rams or second ram rods 28 may extend downward from the crossbar 30, and a second ram bar 40 may be operatively engaged with the second hydraulic rod 26 and slidably attached to the plurality of second ram rods 28 such that the second ram bar 40 may move up and down along a height of the second ram rods 28. Actuation of the second hydraulic rod 26 may pull the second ran bar 40 downward along the height of the second ram rods 28. The second ram bar 40 may also be operatively attached to the second set of ripper teeth 20. For example, a plurality of ripper teeth 20 may extend downward from the second ram bar 40, wherein each ripper tooth 20 is secured to the second ram bar 40 using a ripper tooth bracket 36. In some embodiments, the ripper teeth 20 may extend through the second ram bar 40, wherein a top end of each ripper tooth 20 is secured within a ripper tooth bracket 36 attached to a top surface of the second ram bar 40. As such, when the second hydraulic rod 26 is actuated, the second ram bar 40 may be pulled downward along the second ram rods 28 and toward the bottom corner of the bucket portion 10, causing the ripper teeth 20 to extend outward from orifices in the rear bottom corner of the bucket portion 10, thus resulting in the second plurality of ripper teeth 20 being in the extended or ripper configuration. When the second hydraulic rod 26 is released, the second ram bar 40 may move back along the second ram rods 28 and away from the rear bottom corner of the bucket portion 10, thus pulling the second set of ripper teeth 10 back into the orifice in the rear bottom corner of the bucket portion 10, resulting in the second set of ripper teeth 20 being in the retracted or bucket configuration.

As shown in the Figures, the ripper bucket of the present disclosure may further comprise various guides to help keep the components of the ripper bucket in the proper alignment. For example, the ripper bucket may comprise at least hydraulic system bracket 34 extending upward therefrom, wherein the number of hydraulic system brackets 34 may match the number of hydraulic systems incorporated into the ripper bucket. Each of the hydraulic system brackets 34 may be configured to surround or at least partially surround the respective hydraulic rod to maintain the hydraulic rod in proper alignment when being actuated and released. As shown in, for example, FIGS. 1, 2, 4, and 7, the ripper bucket may further comprise a plurality of guide brackets 32 extending upward from bottom surface of the bucket portion, wherein each guide bracket 32 is configured to provide a channel in which the ram bar can slide up and down. Each guide bracket 32 may prevent forward or backward motion of the ram bar while still allowing the ram bar to move vertically (optionally, at an angle, as shown in FIGS. 5 and 6) up and down.

In embodiments, the ripper bucket may comprise two hydraulic systems, as mentioned above, wherein the first hydraulic system 12 drives movement of two ripper teeth 20 and the second hydraulic system 22 drives movement of three ripper teeth 20. However, the ripper bucket of the present disclosure is not limited to such configuration. Rather, the ripper bucket may comprise one hydraulic system that drives movement of all teeth or more than two hydraulic systems, wherein each hydraulic system drives movement of some of the ripper teeth. When the ripper bucket includes more than one hydraulic system, the ripper bucket may function better than when the ripper bucket includes only a single hydraulic system. Additionally, when the ripper bucket includes multiple hydraulic systems, the hydraulic systems may be actuated at the same time or independently, as desired by the user.

As mentioned above, the ripper bucket of the present disclosure may be designed to be operatively attached to a skid steer 42, wherein the at least one hydraulic system may be operatively attached to an actuation mechanism, such as a button, within the skid steer 42. As such, a user may easily switch between the ripper configuration, wherein the ripper teeth 20 are extended, and the bucket configuration, wherein the ripper teeth are retracted, simply by pushing a button within the skid steer 42. As such, the user may easily and quickly perform both ripper and bucket operations without having to switch machinery. While not particularly limited, the ripper bucket of the present disclosure may mount to the skid steer 42 using conventional bucket mounting brackets, fasteners, and the like.

The above-described embodiments of the invention are presented for purposes of illustration and not of limitation. While these embodiments of the invention have been described with reference to numerous specific details, one of ordinary skill in the art will recognize that the invention can be embodied in other specific forms without departing from the spirit of the invention. Thus, one of ordinary skill in the art would understand that the invention is not to be limited by the foregoing illustrative details, but rather is to be defined by the appended claims.

What is claimed is:

1. A ripper bucket configured to perform both ripper and bucket operations, the ripper bucket comprising:

a bucket portion comprising a bottom wall, a left sidewall, a right sidewall, a back wall, and an interior panel together forming a conventional bucket shape;

a crossbar extending from the left sidewall to the right sidewall;

at least one hydraulic system housed within a space between the interior panel and the back wall, the at least one hydraulic system comprising:

a hydraulic rod; and a ram bar operatively engaged with the hydraulic rod; and retractable ripper teeth operatively attached to the at least one hydraulic system, the retractable teeth configured to extend from and retract into a bottom corner of the bucket portion, wherein:

the ripper bucket is configured to be mounted to a skid steer;

the retractable ripper teeth extend downward from the ram bar;

actuation of the hydraulic rod drives motion of the ram bar and, thus, of the retractable ripper teeth;

the hydraulic rod is attached to the crossbar;

a plurality of ram rods extend downward from the crossbar; and the ram bar is slidably engaged with the plurality of ram rods, such that the ram bar is configured to slide up and down along a height of the plurality of ram rods.

2. The ripper bucket of claim 1, further comprising a plurality of guide brackets extending upward from the bottom wall and engaged with the ram bar to maintain alignment of the ram bar.

3. The ripper bucket of claim 1, further comprising a hydraulic ram guide extending upward from the bucket portion, the hydraulic ram guide comprising a guide configured to maintain alignment of the hydraulic rod.

4. The ripper bucket of claim 1, wherein:

the retractable ripper teeth comprise a first set of ripper teeth and a second set of ripper teeth; and the at least one hydraulic system comprises a first hydraulic system including the first set of ripper teeth and a second hydraulic system including the second set of ripper teeth.

5. The ripper bucket of claim 4, wherein:

the first hydraulic system comprises:

a first hydraulic rod; and a first ram bar operatively engaged with the first hydraulic rod;

the first set of ripper teeth extend downward from the first ram bar;

actuation of the first hydraulic rod drives motion of the first ram bar and, thus, of the first set of ripper teeth;

the second hydraulic system comprises:

a second hydraulic rod; and a second ram bar operatively engaged with the second hydraulic rod;

the second set of ripper teeth extend downward from the second ram bar;

actuation of the second hydraulic rod drives motion of the second ram bar and, thus, of the second set of ripper teeth.

* * * * *